US008839463B2

(12) United States Patent
Fier

(10) Patent No.: US 8,839,463 B2
(45) Date of Patent: Sep. 23, 2014

(54) TROUSER AND METHOD FOR EASING THE STRAIN ON LEGS AND KNEES WHEN MOVING

(76) Inventor: Alyx Fier, Seattle, WA (US)

( * ) Notice: Subject to any disclaimer, the term of this patent is extended or adjusted under 35 U.S.C. 154(b) by 130 days.

(21) Appl. No.: 12/869,567

(22) Filed: Aug. 26, 2010

(65) Prior Publication Data

US 2012/0047629 A1 Mar. 1, 2012

(51) Int. Cl.
*A41D 1/08* (2006.01)
*A41D 1/06* (2006.01)

(52) U.S. Cl.
CPC ..... *A41D 1/06* (2013.01)
USPC ..... 2/227; 2/79

(58) Field of Classification Search
USPC ..... 2/227, 79, 231, 233, 62, 244, 269, 270
See application file for complete search history.

(56) References Cited

U.S. PATENT DOCUMENTS

| | | | | | |
|---|---|---|---|---|---|
| 528,178 | A | * | 10/1894 | Morse | 2/231 |
| 738,677 | A | * | 9/1903 | Hammond | 2/231 |
| 1,040,747 | A | * | 10/1912 | Page | 2/231 |
| 1,173,139 | A | | 2/1916 | Abramson | |
| 1,225,578 | A | | 5/1917 | Cieslik | |
| 1,500,804 | A | | 12/1920 | Crawford | |
| 1,578,970 | A | * | 3/1926 | Feser | 2/231 |
| 1,831,930 | A | * | 11/1931 | Speh | 2/227 |
| 2,663,876 | A | * | 12/1953 | Miller et al. | 2/227 |
| 2,716,754 | A | * | 9/1955 | Hirsch | 2/227 |
| 3,694,818 | A | * | 10/1972 | Nielson | 112/475.09 |
| 3,763,498 | A | * | 10/1973 | Rector | 2/2.15 |
| 4,035,844 | A | * | 7/1977 | Atack et al. | 2/466 |
| 4,117,552 | A | * | 10/1978 | Simpson | 2/2.14 |
| 5,031,242 | A | * | 7/1991 | Aldridge et al. | 2/81 |
| 5,267,354 | A | * | 12/1993 | Grilliot et al. | 2/23 |
| 5,535,450 | A | * | 7/1996 | Melzer | 2/69 |
| 5,653,467 | A | | 8/1997 | Griffin et al. | |
| 5,896,582 | A | * | 4/1999 | Baacke et al. | 2/79 |
| 6,119,274 | A | * | 9/2000 | Graham | 2/242 |
| 6,654,968 | B2 | * | 12/2003 | Braun et al. | 2/269 |
| 6,978,484 | B2 | * | 12/2005 | Donlan et al. | 2/227 |
| 7,065,796 | B2 | * | 6/2006 | Watkins et al. | 2/227 |
| 7,087,032 | B1 | * | 8/2006 | Ikeda | 602/19 |
| D602,229 | S | * | 10/2009 | Clement | D2/742 |
| 7,707,658 | B2 | * | 5/2010 | Culhane | 2/227 |
| 7,958,569 | B2 | * | 6/2011 | Razzaghi et al. | 2/62 |
| 2005/0229292 | A1 | * | 10/2005 | Watkins et al. | 2/227 |
| 2005/0241044 | A1 | * | 11/2005 | Zorica | 2/69 |
| 2005/0251896 | A1 | * | 11/2005 | Donlan et al. | 2/269 |
| 2009/0133182 | A1 | * | 5/2009 | Inagaki et al. | 2/404 |
| 2009/0172859 | A1 | * | 7/2009 | Clement | 2/69 |

FOREIGN PATENT DOCUMENTS

| | | |
|---|---|---|
| JP | 2003020510 | 1/2003 |

* cited by examiner

*Primary Examiner* — Khoa Huynh
*Assistant Examiner* — Andrew W Collins
(74) *Attorney, Agent, or Firm* — Lowe Graham Jones PLLC

(57) ABSTRACT

Trousers and methods for reducing muscle fatigue, and overcoming range of motion restrictions in the legs caused by the friction created by trouser legs rubbing against the knee portion of a person's leg when they are moving are disclosed. In certain embodiments, the trousers and methods use (1) an engineered dart in the mid-thigh region of the trouser, or (2) a zipper to decrease the vertical linear fabric surface in the mid-thigh region of the trouser such that the resulting tension causes the trouser fabric in the knee region to lift out and away from the knee portion of the wear's leg, thusly eliminating or greatly reducing contact between the trouser leg and the wearer's knee and the resulting strain.

21 Claims, 2 Drawing Sheets

TROUSER AND METHOD FOR EASING THE STRAIN ON LEGS AND KNEES WHEN MOVING

FIELD OF THE INVENTION

This invention is in the field of work-wear; human powered sports such as hiking, climbing and biking; and any other activity that involves repetitive movement of the legs. Specifically this invention relates to trousers and related methods that significantly reduce the strain associated with a person's knees rubbing against the fabric of their trouser's leg.

BACKGROUND OF THE INVENTION

As a person raises their leg to take a step the knee comes in contact with the fabric of the trouser and the trouser fabric then rides up and over the knee creating friction. This friction in turn requires extra muscle energy to overcome the friction which results in an increased rate of muscle fatigue. In extreme cases, such as a stiff pair of rain pants, this friction can severely limit the wearer's range of motion. When a person is climbing, such as a ladder or a hill, or when squatting and standing, this effect and the resulting fatigue are significantly amplified.

There are other devices that have been developed to prevent the fabric in the knee portion of the trouser from getting stretched out in men's suits, such as U.S. Pat. No. 1,225,578 to Cieslik which discloses a detachable system worn on the inside of the trouser for raising the trouser leg when the wearer sits. However, this system actually relies on, and increases, friction across the knee to tension the belt and raise the trouser leg to prevent "bagging" of the knee. Likewise, U.S. Pat. No. 1,500,804 to Crawford discloses a non-removable set of straps attached to the posterior portion of the trouser leg which lifts the trouser leg when sitting. U.S. Pat. No. 1,173,139 to Abramson teaches a non-removable set of straps attached to the anterior portion of a trouser leg which likewise lifts the trouser leg when sitting.

Another method of raising the fabric of the trouser leg, Japanese patent application No. 2001-246805, discloses an elastic strap with a clip at one end for attaching to the trouser's belt, and a clip at the other end which is attached to the fabric of the trouser leg in the region of the knee. The tension of the elastic provides a continuous upward force which pulls the trouser leg up much like the effect you would achieve by grasping the fabric with your hand and pulling upward.

While providing a means for lifting the fabric of the trouser leg all prior methods had a number of disadvantages:

a. To prevent the fabric of the knee from becoming stretched the fabric is lifted by tensioning a strap against the wearer's leg at the cost of increased friction from the straps against the wearer's legs which results is increased muscle fatigue.
b. The cost of the strapping material and the cost of installing the strapping in the garment is significantly higher than the present invention.
c. The strapping material brings added weight to the trouser which has the effect of increasing fatigue since that added weight must be lifted by the leg each time the leg is raised.
d. The continual chaffing of the straps against the leg would be uncomfortable and annoying for anyone involved in active endeavors such as work or sports.
e. Elastic straps on the exterior of the garment present a safety hazard for work or sports as they can easily snag and lead to injury.

f. The tension of the elastic straps would continually vary depending on heat, moisture, wear and tear and other variables such that the performance would be inconsistent and require continual adjustment.
g. Having an elastic strap continually pulling upward can feel unnatural and uncomfortable when worn for long periods such as during work assignments.

The present invention provides novel trousers and related methods of strain relief that overcomes the shortcomings of the previous inventions. Besides reducing stress on the body's muscular skeletal system, it also increases the wearer's range of movement in a safe and consistent manner. Several objects and advantages of the current invention are:

a. to reduce stress on the muscles and joints of a person's legs during physical activities such as walking, climbing, squatting and other repetitive movements in a manner that is comfortable to use.
b. to provide a method for reducing stress on the muscles and joints of a person's legs from repetitive movements in a manner that is consistently safe and will not pose a hazard due to snagging or spontaneously releasing under load.
c. to provide a method for reducing stress on the muscles and joints of a person's legs from repetitive movements in a manner that does not require continual adjustment by the wearer due to changing environmental conditions, or degradation of the support materials over time.
d. to provide a method for reducing stress on the muscles and joints of a person's legs in a manner that retains a consistent result throughout the lifespan of the garment.
e. to provide a method for reducing stress on the muscles and joints of a person's legs in a manner that will provide greater utility for the wearer due to it's convenience and ease of use.
f. to provide a method for reducing stress on the muscles and joints of a person's legs in a manner that is stylish and is more likely to be adopted and utilized because it does not impact the visual appeal of the garment.
g. to provide a method for reducing stress on the muscles and joints of a person's legs in a manner that does not increase the stress through added weight or friction.

Further objects and advantages of the present invention are to provide a method of stress relief which is inherent to garments, which can be easily and inexpensively manufactured, which is light in weight, which is reliable and which requires no instruction or proficiency to use. Still further objects and advantages will become apparent from a consideration of the ensuing descriptions and drawings.

SUMMARY OF THE INVENTION

Methods for reducing stress on the muscles and joints of a person's leg caused by friction created by fabric of a trouser rubbing against an anterior region of a knee portion of the person's leg when the person raises their leg are disclosed. The method for reducing the friction created by trouser legs rubbing against the knee portion of a person's leg in the present invention reduces muscle fatigue and overcomes range of motion restrictions in the legs. The methods of the present invention generally involve the creation of a dart or gather at the mid-thigh region of a pair of trousers which has the effect of lifting the fabric in the knee portion of the trouser out and away from the wearer's knee, thusly preventing friction between the knee and the trouser leg.

In one embodiment, the method comprises: (a) supplying a trouser that comprises (i) an elliptical shape cut into a lower edge of an upper mid-thigh anterior trouser fabric portion, (ii)

an elliptical shape cut into an upper edge of a lower mid-thigh anterior trouser fabric portion which mirrors the elliptical shape of said upper mid-thigh anterior trouser fabric portion and (iii) a holding mechanism for securing the elliptically cut edges of the upper and lower mid-thigh anterior trouser fabric portions, thereby creating a dart in an anterior region between a midpoint and a top edge of each leg of the trouser; and (b) allowing the dart to cause fabric in a knee portion of the trouser to lift out and away from a wearer's knee, thusly preventing friction between the knee and the leg of the trouser.

In other embodiments, the method comprises: (a) supplying a trouser that comprises (i) a gather in the fabric of the trouser in an anterior region between a midpoint and a top edge of each leg of the trouser and (ii) a holding mechanism for affixing the gather to an adjoining area of fabric such that the gather is immovable; and (b) allowing the gather to cause fabric in a knee portion of the trouser to lift out and away from the person's knee, thusly preventing friction between the knee and the leg of the trouser.

In additional embodiments, the method comprises: (a) supplying a trouser that comprises (i) a re-closable fastener having a pliable form which can form a 'V' shape when open and a straight line when closed and (ii) a holding mechanism for permanently affixing the re-closable fastener in an anterior region between a midpoint and a top edge of each leg of the trouser, thereby creating a gather in the anterior region between the midpoint and the top edge of each leg of the trouser when the fastener is closed; and (b) allowing the gather to cause fabric in a knee portion of the trouser to lift out and away from the person's knee, thusly preventing friction between the knee and the leg of the trouser.

Also disclosed are trousers that reduce stress on the muscles and joints of a person's leg caused by friction created by fabric of the trouser rubbing against an anterior region of a knee portion of the person's leg when the person raises their leg.

In one embodiment, the trouser comprises a dart positioned at an anterior region between a midpoint and a top edge of each leg of the trouser, wherein the dart causes a knee portion of the trouser to lift out and away from a wearer's knee. In certain embodiments, the dart comprises an elliptical shape cut into a lower edge of an upper mid-thigh anterior trouser fabric portion, an elliptical shape cut into an upper edge of a lower mid-thigh anterior trouser fabric portion which mirrors the elliptical shape of the upper mid-thigh anterior trouser fabric portion and a holding mechanism for securing the elliptically cut edges of the upper and lower mid-thigh anterior trouser fabric portions.

In other embodiments, the trouser comprises a gather in the fabric of the trouser positioned at an anterior region between a midpoint and a top edge of each leg of the trouser and a holding mechanism for affixing the gather to an adjoining area of fabric such that the gather is immovable, wherein the gather causes fabric in a knee portion of the trouser to lift out and away from a wearer's knee.

In additional embodiments, the trouser comprises a re-closable fastener having a pliable form which can form a 'V' shape when open and a straight line when closed and a holding mechanism for permanently affixing the re-closable fastener in an anterior region between a midpoint and a top edge of each leg of the trouser, wherein a gather is created in the anterior region between the midpoint and the top edge of both legs of the trouser when the fastener is closed which causes fabric in a knee portion of the trouser to lift out and away from a wearer's knee.

In further embodiments, with respect to both the methods and the trousers of the present invention, (a) the fabric of the trouser is a woven material and the holding mechanism comprises a chain of stitches, (b) the fabric of the trouser is a woven material coated with a synthetic material and the holding mechanism is a welding secured using heat and pressure, (c) the fabric of the trouser is a synthetic material and the holding mechanism is a welding secured using heat and pressure, (d) the fabric of the trouser is a synthetic sheet good and the holding mechanism is an adhesive tape, or (e) the holding mechanism is a re-closable fastener.

BRIEF DESCRIPTION OF THE DRAWINGS

Preferred and alternative embodiments of the present invention are described in detail below with reference to the following drawings. These depict particular embodiments of the invention and are not intended to limit the scope of the invention set forth in the claims.

DETAILED DESCRIPTION OF THE PREFERRED EMBODIMENTS

Figure 1:
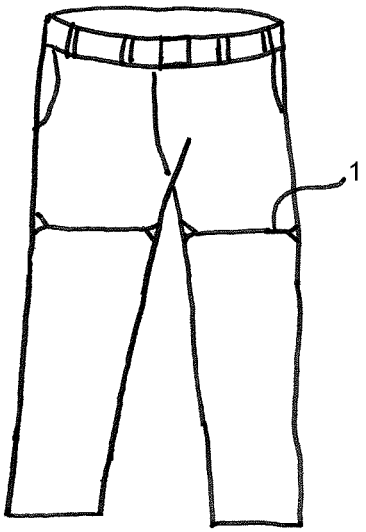
FIG. 1 shows an overview of an exemplary trouser with the preferred embodiment of a sewn dart, or gather in the fabric, at mid-thigh, in accordance with an embodiment of the present invention.
Figure 2:
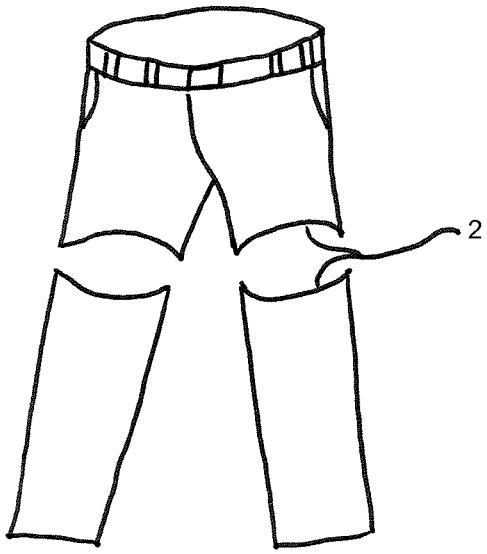
FIG. 2 is a front view of the trouser legs showing the shape of the fabric pieces before they're sewn together to form the dart, in accordance with an embodiment of the present invention.
Figure 3:
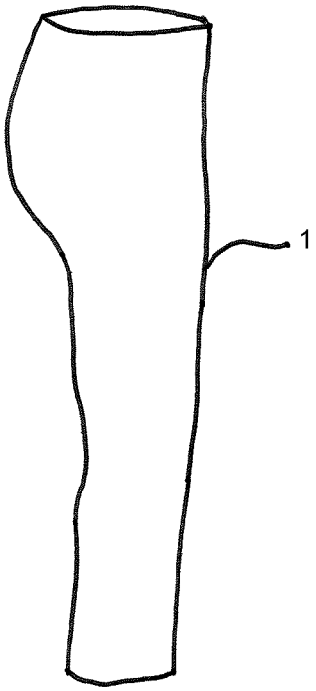
FIG. 3 is a side view of the trousers showing how the dart holds the fabric in the leg of the trouser away from the wearer's knee, in accordance with an embodiment of the present invention.
Figure 4:
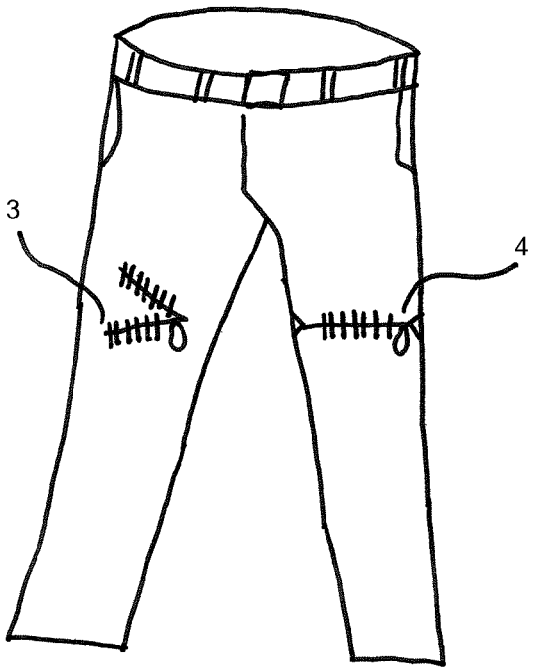
FIG. 4 is a front view of the trouser legs showing the use of a zipper to create the dart in the fabric of the trouser leg, in accordance with an embodiment of the present invention.
Figure 5:
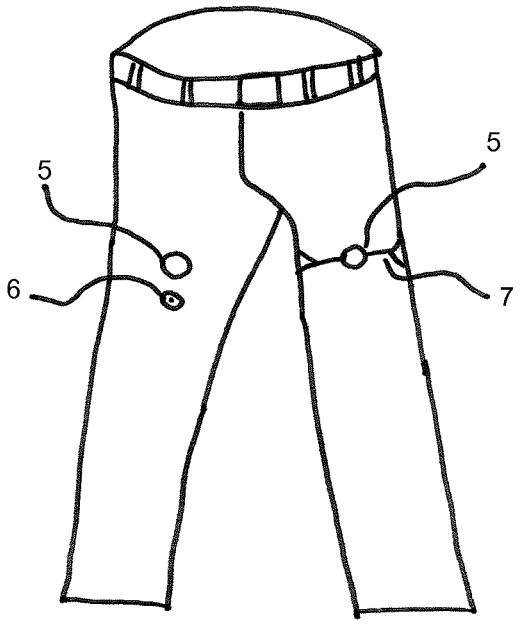
FIG. 5 is a front view of the trouser legs showing use of a snap to create the dart in the fabric of the trouser leg, in accordance with an embodiment of the present invention.

A preferred embodiment of the present invention is illustrated in FIG. 1 which shows a pair of trousers with a dart 1 sewn into the fabric using a chain of stitches (not shown) in the anterior mid-thigh region. FIG. 2 shows the upper and lower portions of the trouser legs before they are joined with a convex shape 2 cut into the fabric edges which when joined using the chain of stitches (not shown) causes the lower anterior leg portion of the fabric to become tensioned. FIG. 3 shows the dart 1 tensioning the fabric in the anterior leg portion of the trouser leg such that the fabric is pulled up and out from the anterior knee portion of the wearer's leg. FIG. 4 shows another embodiment of the present invention in which a dart is created using a fixed length zipper 3 sewn to the fabric in the anterior portion of the trouser leg in a 'V' shape, and the same zipper closed 4 to create the dart. FIG. 5 shows another embodiment of the present invention in which a dart is created using a snap assembly affixed to the fabric in the upper anterior portion of the trouser leg comprising a cap 5 and a stud 6 which when closed by pressing together create a dart 7.

Although differing in particulars, all of the embodiments described above use the same method of creating a dart or gather to tension the fabric in the anterior leg portion of a pair of trousers such that the fabric is pulled out and away from the anterior knee portion of the wearer's leg thusly reducing the friction that would otherwise occur when the legs are moving.

Although the descriptions above contain specifics, these should not be construed as limiting the scope of the invention but as providing illustrations of some of the presently preferred embodiments of this invention. Many of the elements of these embodiments are interchangeable and many other variations are possible.

For example, in the zippered version described above, the zipper could be sewn into an elliptical shape similar to the convex fabric edges in the sewn version rather than the 'V' shape described. It is also anticipated that other two-part closure methods, such as hook & loop or buckles, could be used in place of the snap assembly to create a dart in the fabric. Other such holding mechanisms for creating the dart or gather, in addition to the chain of stitches, zipper and snap assembly discussed above, include adhesive tape and weldings secured using heat and pressure. The trousers themselves can be made from various materials conventionally used for this purpose, including without limitation synthetic and natural woven materials, woven materials coated with a synthetic material, various synthetic materials, synthetic sheet goods, various combinations of the foregoing materials and the like.

Such variations are not to be regarded as a departure from the spirit and scope of the present invention and all such modifications as would be apparent to one skilled in the art should be included within the scope of the following claims and their legal equivalents.

The embodiments of the invention in which an exclusive property or privilege is claimed are defined as follows:

1. A trouser comprising trouser fabric, the trouser fabric having a knee region, an anterior region, and a posterior region and a dart positioned at the anterior region above the knee region, the dart shortening the anterior region relative to the posterior region to generate sufficient tension in the anterior region wherein the dart causes the knee region of the trouser to lift out and away from a wearer's knee upon movement of the wearer's knee, wherein the trousers have an inseam, an outseam, and a middle portion on the anterior region between the inseam and the outseam and the dart is formed by linking a first elliptical shaped cut and a second elliptical shaped cut in the trouser fabric that provides an uninhibited range of movement for the wearer's knee.

2. The trouser of claim 1, wherein the the first elliptical shaped cut is at an upper edge of a lower mid-thigh anterior trouser fabric portion and mirrors the second elliptical shaped cut that is between a belt region and the dart and the trouser further comprises a holding mechanism for linking the first and the second elliptical shaped cuts to form the dart.

3. The trouser of claim 1, wherein the fabric of the trouser is at least one of a woven material, a woven material coated with a synthetic material, a synthetic material, or a synthetic sheet good, and wherein the trouser further comprises a holding mechanism for linking the first and the second elliptical shaped cuts to form the dart and the holding mechanism includes at least one of a chain of stitches, a welding secured using heat and pressure or an adhesive tape.

4. The trouser of claim 1, further comprising a holding mechanism for linking the first and the second elliptical shaped cuts to form the dart at an adjoining area of the trouser fabric.

5. The trouser of claim 1 wherein the dart causes an angle between an upper mid-thigh anterior trouser fabric portion and a lower mid-thigh anterior trouser fabric portion toward the front of the trouser, such that when the trouser is laid flat and viewed from the side, the angle is less than approximately 180° to the front of the trouser.

6. The trouser of claim 1 wherein a lower edge of the dart is above the wearer's knee.

7. The trouser of claim 1 wherein a gather is created in the anterior region between a midpoint and a top edge of both legs of the trouser when the dart is formed which causes the trouser fabric above the knee region of the trouser to lift out and away from the wearer's knee.

8. The trouser of claim 4, wherein the holding mechanism is a zipper.

9. The trouser of claim 1, wherein the trouser fabric is a woven material.

10. The trouser of claim 1, wherein the trouser fabric is a woven material coated with a synthetic material.

11. The trouser of claim 1, wherein the trouser fabric is a synthetic material.

12. The trouser of claim 1, wherein the trouser fabric is a synthetic sheet good.

13. The trouser of claim 4, wherein the holding mechanism positioned in an anterior region between a midpoint and a top edge of each leg of the trouser, thereby creating a gather in the trouser fabric in the anterior region between the midpoint and the top edge of each leg of the trouser.

14. The trouser of claim 4, wherein the holding mechanism comprises a chain of stitches.

15. The trouser of claim 4, wherein the holding mechanism is a welding secured using at least heat.

16. The trouser of claim 4, wherein the holding mechanism is a welding secured using at least pressure.

17. The trouser of claim 4, wherein the holding mechanism is an adhesive tape.

18. The trouser of claim 4, wherein the trouser fabric is a woven material and the holding mechanism comprises a chain of stitches.

19. The trouser of claim 4, wherein the trouser fabric is a woven material coated with a synthetic material and the holding mechanism is a welding secured using heat and pressure.

20. The trouser of claim 4, wherein the trouser fabric is a synthetic material and the holding mechanism is a welding secured using heat and pressure.

21. The trouser of claim 4, wherein the trouser fabric is a synthetic sheet good and the holding mechanism is an adhesive tape.

* * * * *